US006227655B1

(12) United States Patent
Desie et al.

(10) Patent No.: US 6,227,655 B1
(45) **Date of Patent: *May 8, 2001**

(54) DEP (DIRECT ELECTROSTATIC PRINTING) DEVICE MAINTAINING A CONSTANT DISTANCE BETWEEN PRINTHEAD STRUCTURE AND TONER DELIVERY MEANS

(75) Inventors: Guido Desie, Herent; Günther Dieltjens, Grobbendonk; Ludovicus Joly, Hove, all of (BE)

(73) Assignee: Agfa-Gevaert, Mortsel (BE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 11 days.

(21) Appl. No.: 09/064,559

(22) Filed: Apr. 22, 1998

Related U.S. Application Data

(60) Provisional application No. 60/049,095, filed on Apr. 9, 1997.

(30) Foreign Application Priority Data

Apr. 29, 1997 (EP) ..... 97201283

(51) Int. Cl.[7] ..... B41J 2/06
(52) U.S. Cl. ..... 347/55
(58) Field of Search ..... 347/55, 154, 103, 347/123, 111, 159, 127, 128, 17, 141, 120, 151; 399/271, 290, 292, 293, 294, 295

(56) References Cited

U.S. PATENT DOCUMENTS

| | | | | |
|---|---|---|---|---|
| 5,448,272 | | 9/1995 | Kagayama | 347/55 |
| 5,495,273 | | 2/1996 | Kitamura | 347/55 |
| 5,552,814 | * | 9/1996 | Maeda et al. | 347/55 |
| 5,559,544 | | 9/1996 | Sato | 347/127 |
| 5,774,158 | * | 6/1998 | Desie et al. | 347/141 |
| 5,874,973 | * | 2/1999 | Wakahara | 347/55 |
| 5,880,760 | * | 3/1999 | Desie et al. | 347/55 |
| 5,984,443 | * | 11/1999 | Desie et al. | 347/55 |

FOREIGN PATENT DOCUMENTS

| | | |
|---|---|---|
| 0712056 | 5/1915 | (EP) . |
| 0675417 | 10/1995 | (EP) . |
| 0740224 | 10/1996 | (EP) . |
| 9524675 | 9/1995 | (WO) . |

OTHER PUBLICATIONS

Derwent Abstract.

* cited by examiner

*Primary Examiner*—John Barlow
*Assistant Examiner*—Raquel Yve He Gordon
(74) *Attorney, Agent, or Firm*—Baker Botts L.L.P.

(57) ABSTRACT

A device for direct electrostatic printing (DEP) is provided comprising a device having an external surface carrying toner particles for generating a flow of toner particles to an image receiving member and a printhead structure, having two major faces, interposed in the flow of toner particles for image-wise modulating this flow, wherein the external surface moves in a direction A and the printhead structure is kept at a constant distance, D, from that external surface by spacing elements forming an angle between 45° and 0° with direction A and being located at a distance d from each other such that 1 cm≦d≦50 cm. In a preferred embodiment the spacing elements are located at a distance d such that 5 cm≦d≦35 cm and the constant distance D is kept between 25 and 500 μm.

12 Claims, 3 Drawing Sheets

DEP (DIRECT ELECTROSTATIC PRINTING) DEVICE MAINTAINING A CONSTANT DISTANCE BETWEEN PRINTHEAD STRUCTURE AND TONER DELIVERY MEANS

The application claims the benefit of the U.S. Provisional Application No. 60/049,095 filed Apr. 9, 1997.

DESCRIPTION

1. Field of the Invention

This invention relates to a printing device useful in direct electrostatic printing (DEP). In DEP, electrostatic printing is performed directly from a toner delivery means on a toner receiving member by means of an electronically addressable printhead structure.

2. Background of the Invention

In DEP (Direct Electrostatic Printing) the toner or developing material is deposited directly in an imagewise way on a receiving substrate, the latter not bearing any imagewise latent electrostatic image. In the case that the substrate is an intermediate endless flexible belt (e.g. aluminium, polyimide etc.), the imagewise deposited toner must be transferred onto another final substrate. If, however, the toner is deposited directly on the final receiving substrate, a possibility is fulfilled to create directly the image on the final receiving substrate, e.g. plain paper, transparency, etc. This deposition step is followed by a final fusing step.

This makes the method different from classical electrography, in which a latent electrostatic image on a charge retentive surface is developed by a suitable material to make the latent image visible. Further on, either the powder image is fused directly to said charge retentive surface, which then results in a direct electrographic print, or the powder image is subsequently transferred to the final substrate and then fused to that medium. The latter process results in an indirect electrographic print. The final substrate may be a transparent medium, opaque polymeric film, paper, etc.

DEP is also markedly different from electrophotography in which an additional step and additional member is introduced to create the latent electrostatic image. More specifically, a photoconductor is used and a charging/exposure cycle is necessary.

A DEP device is disclosed in e.g. U.S. Pat. No. 3,689,935. This document discloses an electrostatic line printer having a multi-layered particle modulator or printhead structure comprising:

- a layer of insulating material, called isolation layer;
- a shield electrode consisting of a continuous layer of conductive material on one side of the isolation layer;
- a plurality of control electrodes formed by a segmented layer of conductive material on the other side of the isolation layer; and
- at least one row of apertures.

Each control electrode is formed around one aperture and is isolated from each other control electrode.

Selected potentials are applied to each of the control electrodes while a fixed potential is applied to the shield electrode. An overall applied propulsion field between a toner delivery means and a receiving member support projects charged toner particles through a row of apertures of the printhead structure. The intensity of the particle stream is modulated according to the pattern of potentials applied to the control electrodes. The modulated stream of charged particles impinges upon a receiving member substrate, interposed in the modulated particle stream. The receiving member substrate is transported in a direction orthogonal to the printhead structure, to provide a line-by-line scan printing. The shield electrode may face the toner delivery means and the control electrode may face the receiving member substrate. A DC-field is applied between the printhead structure and a single back electrode on the receiving member support. This propulsion field is responsible for the attraction of toner to the receiving member substrate that is placed between the printhead structure and the back electrode. The printing device as described in the original Pressman patent is very sensitive to changes in distances from the toner application module towards said shield electrode, leading to changes in image density.

The problem of keeping this distance constant has been addressed in several ways.

In EP-A 675 417 it is disclosed to use a magnetic brush as toner delivery means, using a two-component developer (comprising toner and carrier particles), and to provide "long hairs" on said brush so that the hairs touch the printing structure. In that case slight deviations in distance between the surface of the toner delivery means and the printhead structure do no longer present problems, while in any case the hairs of the brush, made up by carrier particles and toner particles are in contact with the printhead structure. It was found that such a device could provide very good printing results, but yielded only adequate optical density in the print when the printing speed was not too high. The problem of varying image density, that can remain in a device according to EP-A 675 417, due to a varying distance between the surface of the magnetic brush and the printhead structure can further be decreased by adapting the electrical conductivity of the carrier particles used on the magnetic brush as described in EP-A 836 124.

For devices working at quite high printing speeds, the use of a charged toner conveyer (a CTC), whereon the toner particles can be deposited by a magnetic brush or any other means known in the art, presents advantages. But the problem of uneven density (white banding) in a direction perpendicular to the printing direction has to be solved.

In EP-A 740 224 a device is described in which the frequency of said density banding (in a direction perpendicular to the printing direction) due to the variation of the distance from the toner application module towards said printhead structure is diminished. To achieve this better evenness in printing, it is disclosed to give the toner bearing surfaces of the toner delivery means rather high rotational speeds. Since the surfaces that bear the toner particles rotate very fast and the distance between said toner bearing surfaces and the printhead structure is low, the particles are exposed to quite large shearing force. This high shearing force can give raise to agglomeration and/or deformation of the toner particles (especially when in the toner particles polymeric toner resins with low (<60° C.) Tg are used. Thus the printing apertures can be clogged by agglomerated or deformed toner particles, leading to images with missing dots and bad image quality.

In U.S. Pat. No. 5,552,814 it is disclosed to use a device wherein the CTC and the printhead structure are in close contact. Such a device does indeed decrease the banding in the direction perpendicular to the printing direction, but, as with the fast moving CTC's in EP-A 740 224 referred to above, the particles are exposed to quite large shearing forces. This high shearing force can give raise to agglomeration and/or deformation of the toner particles and thus to some clogging of printing apertures. To diminish that problem it has been proposed in U.S. Pat. No. 5,497,175 to provide a layer with very low coefficient of friction on the face of the printhead structure contacting the CTC or, in U.S. Pat. No. 5,539,438, to provide a layer with low coefficient of friction on the surface of the CTC. These layers may influence the charge or the chargeability of the toner particles and can thus, in some instances, negatively influence the printing quality.

In U.S. Pat. No. 5,448,272 an other approach to diminish the shearing forces on the toner particles in a DEP device wherein the CTC contacts the printhead structure has been disclosed. On the face of the printhead structure contacting the CTC a kind of guiding members are provided in the spacing between the printing apertures, and only these guiding members are in contact with the CTC. The guiding members are wedge shaped, with the point of the wedge against the toner feeding direction. In operation the guiding members, that keep the distance between the printhead structure and the CTC constant, "plough" through the layer of toner particles on the CTC and guide the particles to the printing apertures. A drawback of this device is the difficulty of manufacturing such a printhead structure with the desired accuracy for high resolution printers (50 dpi or higher). A high resolution printer necessitates a printhead structure with small apertures and small spacing between the printing apertures, necessitating a very accurate positioning of the guiding members.

In JP-A 08/300715 a printhead structure with "guiding means" is disclosed, wherein the guiding means are placed before the printing apertures and are form an angle with the direction of movement of the toner delivery means. Again at least one guiding means per printing aperture is provided. Thus also in this device a very accurate positioning of the guiding members is required, which complicates the manufacture of the printhead structure.

It is thus still desired to have DEP printing devices wherein the distance between the toner delivery means and the printhead structure is kept constant, wherein the toner particles are not subjected to excessive shear and that is relatively simple to manufacture.

3. OBJECTS AND SUMMARY OF THE INVENTION

It is an object of the invention to provide a direct electrostatic printer that makes it possible to print at high speed, with good evenness of printing.

It is an other object of the invention to provide a direct electrostatic printer that makes it possible to print at high speed and wherein the clogging of the printing apertures by toner particles is minimized.

Further objects and advantages of the invention will become clear from the description hereinafter.

The objects of the invention are realized by providing a device for direct electrostatic printing comprising:

means with an external surface carrying charged toner particles for creating a flow of toner particles, means for moving said external surface in a direction A, a printhead structure, having a first and a second major face, with printing apertures and control electrodes, placed in said flow of toner particles for image-wise controlling said flow, said first major face of said printhead structure facing said external surface and at least two spacing means placed between said first major surface and said external surface under an angle between 45° and 0° with respect to said direction A and at a distance, d, from each other so that 1 cm≦d≦50 cm for keeping said first major face and said external surface a a constant distance, D, from each other.

In a preferred embodiment said spacing means are placed at a distance d from each other such that 5 cm≦d≦35 cm.

In a further preferred embodiment said constant distance D is such that 25 μm≦D≦500 μm.

4. BRIEF DESCRIPTION OF THE DRAWINGS

5. DETAILED DESCRIPTION OF THE INVENTION

Figure 1:
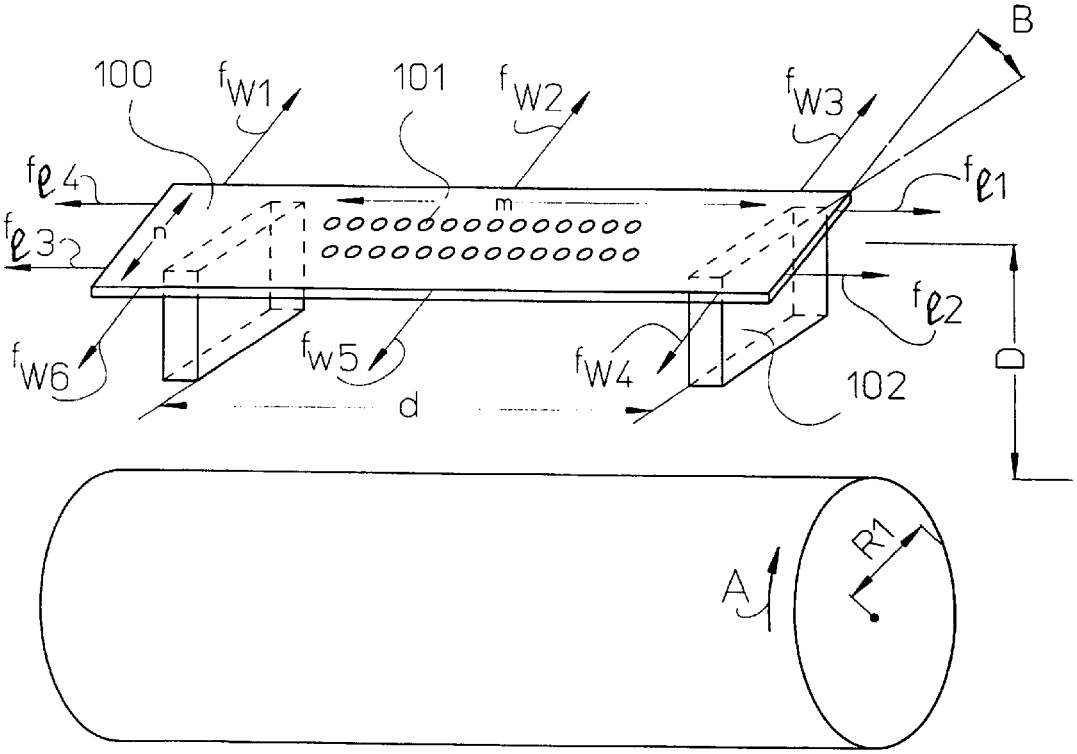
FIG. 1 shows a schematic view, viewed from the outer (external) surface of the toner delivery means, of a printhead structure according to this invention.

Herein after the means for delivering toner particles, present in DEP devices according to this invention will be indicated by the wording "toner delivery means". The "toner delivery means" has an external surface carrying charged toner particles and from said surface a flow of toner particles is generated.

It was found that it was possible in a DEP printing device to keep the distance D between the printhead structure and the toner delivery means constant by far less spacing means than disclosed in e.g. U.S. Pat. No. 5,448,272. It was found that it was possible to keep said distance D constant using between the printhead structure and the toner delivery means spacing means that were at least from 1 cm up to 50 cm apart (the distance between the spacing means is measured between the faces of the spacing means facing each other). Thus in a printer according to this invention, having a resolution of 50 dpi or dots per inch—which equals approximately to 20 dots per cm—this means that, with the spacing means 1 cm apart, instead of having at least a spacing means for every aperture as in U.S. Pat. No. 5,448,272, in a device according to this invention, there are two spacing means accomodating at least 20 printing apertures, which largely facilitates the construction of the printing device. It was found that a very satisfying compromise between ease of manufacture and evenness of the printing could be achieved when the spacing means were between 5 and 35 cm, both limits included, apart.

It was further found that the spacing means, in a device according to this invention, were advantageously constructed such that the distance D between the printhead structure and the toner delivery means was between 25 and 500 μm, more preferably between 50 and 300 μm. The advantage of the larger distance D (in e.g. U.S. Pat. No. 5,448,272 it is said that a distance D of one toner diameter is enough) is not only a substantial prevention of toner smearing by shearing forces exerted on the toner and of the clogging of the printing apertures, but also that the device can be operated with more than 1 layer of toner particles on the surface of the toner delivery means. Having more than 1 layer of toner particles on the toner delivery means, brings more toner particles per unit of time available for printing and thus provides in high printing density at high printing speed.

It was also found that, in a device according to this invention, it was advantageous for high printing speed that on the toner delivery means and an AC-field was superimposed. This AC-field is then applied to the surface (sleeve) of the toner delivery means. This AC-field creates, in the gap determined by the distance D, a kind of cloud of free vibrating toner particles. This cloud of free vibrating toner particles brings even more toner particles per unit of time available for printing and thus provides in high printing density at high printing speed. The AC-field, in a device according to this invention, has preferable a frequency between 1 and 5 kHz and can have a sinusoidal, square or triangular shape, it can be a symmetrical as well as an asymmetrical signal. In a device according to this invention this AC-field can be applied on the sleeve of the toner delivery means, when the DC-voltage on the sleeve of the toner delivery means is 0 (i.e. the sleeve is grounded) as well as when the DC-voltage on the sleeve has either a positive or a negative value. The root mean square voltage ($V^{rms}$) of the AC-field superimposed on the DC-field between printhead structure and toner delivery means, preferably relates to the voltage of the DC-field. More preferably the root means square voltage of the AC-field ($V^{rms}$)is preferably at least 10 times higher than the voltage of the DC-field on which it is superimposed. When the voltage of the DC-field on the sleeve is zero (i.e. when the sleeve is grounded) and an AC-field is applied, then $|AC/DC|=\infty$, which is the upper limit for the ratio $|AC/DC|$.

The ratio of AC/DC is taken as an absolute value, ($|AC/DC|$) so that the ratio is independent of the sign of the DC-field.

The spacing means in a device according to this invention can have different shapes, it can be a row of dots, a row of bars, a bar, they can be rectangular, cylindrical, triangular, etc as long as they perform the effect of keeping the distance between the printhead structure and the toner delivery means constant. The spacing means can be made of any material, although spacing means made of insulating material, e.g. polymeric material, ceramic material, are largely preferred. The insulating material can preferably be a flexible polymeric material as e.g. a polyester, a polyimide, a polyamide, a polyurethane, a polycarbonate, etc.

The face of the spacing means contacting the outer (external) surface of the toner delivery means can be provided with a friction reducing layer for aiding the smooth gliding of the face of the spacing means over the surface of the toner delivery means. Such a layer can comprise a solid lubricant dispersed in a binder, e.g. disulfide of molybdenum dispersed in a binder, as disclosed in U.S. Pat. No. 5,497,175, the layer can be made with a perfluorpolymer (e.g. TEFLON (tradename), the friction reducing layer can comprise matting agents protruding above the layer, which diminish the surface of the spacing means contacting the surface of the toner delivery means. Such spacing particles can advantageously comprise a lubricant (e.g. a wax) as described in EP-A 241 600 or comprise fluor-containing compounds as described in EP-A 281 848.

The spacing means used in a device according to this invention can be permanently attached to the face of the printhead structure facing the external surface of the toner delivery means or can be placed between said face of the printhead structure and the surface of the toner delivery means. In the latter case the spacing particles are kept in place by pressing the toner delivery means against the spacing means that are pressed against the printhead structure.

In a device according to this invention, the printhead structure is preferably kept in contact with the surface of the toner delivery means via the spacing means, permanently mounted on the printhead structure or simply interposed between the printhead structure and the outer (external) surface of the toner delivery means, by resilient means. When the printhead structure comprises a resilient substrate, e.g. a polymeric sheet material, being between 50 and 400 $\mu$m thick, wherein printing apertures are present the contact of the printhead structure with the toner delivery means, via the spacing means, can be assured by the own resilience of the printhead structure. Suitable material to be used as polymeric sheet material, with a certain resilience, in a printhead structure useful in this invention are e.g. polyester, polyimide, polyamide, polyurethane, polycarbonate, etc.

Even if the printhead structure has a certain resilience of its own, it is preferred, in a device according to this invention, to use resilient means to keep printhead structure and toner delivery means in contact.

The resilient means keeping the printhead structure and the toner delivery means in contact via the spacing means can be springs, coil springs, rubber bands, etc.

FIG. 1 shows a schematic view, viewed from the outer (external) surface of the toner delivery means, of a printhead structure according to this invention. The printhead structure (100) comprises an array of printing apertures (101) located between two spacing means (102). The spacing means are positioned over a distance (d) apart. When such a printhead structure is mounted in a DEP device with the spacing means (102) in contact with the toner delivery means, several forces, in FIG. 1 represented by the arrows, are exerted on the printhead structure. In the direction parallel with the array of printing apertures (herein after termed the length of the printhead structure), forces $f_{l1}$, $f_{l2}$, $f_{l3}$ and $f_{l4}$ are exerted on the printhead structure. The sum of these forces will be referred to as $F_l$. In the direction perpendicular to the array of printing apertures (herein after termed the width of the printhead structure), forces $f_{w1}$, $f_{w2}$, $f_{w3}$, $f_{w4}$, $f_{w5}$ and $f_{w6}$ are exerted on the printhead structure. The sum of these forces will be referred to as $F_w$. The forces $f_{w2}$ and $f_{w5}$ are exerted between the spacing means, and the sum of them will be referred to as $F_{wb}$. Forces $f_{w1}$, $f_{w3}$, $f_{w4}$ and $f_{w6}$ are exerted outside the spacing means, and the sum of them will be referred to as $F_{wo}$. The values of $F_l$ and $F_w$ are related to the distance where over they act on the printhead structure and are thus expressed in N/m. In FIG. 1 the forces $f_{l1}$ and $f_{l2}$ have points of application spaced by a distance of n meter, thus $F_l=(f_{l1}+f_{l2}+f_{l3}+f_{l4})/n$. In FIG. 1 forces $f_{w1}$ and $f_{w3}$ have points of application spaced by a distance of m meter, thus $F_w=(f_{w1}+f_{w2}+f_{w3}+f_{w4}+f_{w5}+f_{w6})/m$. In FIG. 1 $F_w$ is made up of six forces, two acting between the spacing means and four acting outside the spacing means, thus $F_{wb}=⅔$ times $F_w$ and $F_{wo}=⅔$ times $F_w$.

The forces, acting on the printhead structure, are in FIG. 1 shown as being exactly parallel or exactly perpendicular to the direction of the printing apertures. However the resilient means exerting said forces, can, in a DEP device according to this invention, be placed in a position deviating from the exact parallel or exact perpendicular position.

Although with any resilient positioning of a printhead structure in a DEP device according to the present invention could achieve good printing density at acceptable speed combined with good printing evenness and could largely avoid the smearing of toner and the clogging of printing apertures, it was found that the printing quality with a device according to the present invention could further be ameliorated when the forces exerted on the printhead structure by the resilient means were adapted to each other. The printing quality was found to be ameliorated $F_w/F_l \leqq 0.5$, and substantially ameliorated when $F_w/F_l \leqq 0.25$. When further $F_w$ was adapted to the distance d between the spacing means, such that $F_w/d<5000$, the printing quality was further enhanced. Further improvement of the printing quality could be observed when $F_{wb}/F_{bo} \leqq 1.00$.

Figure 2:
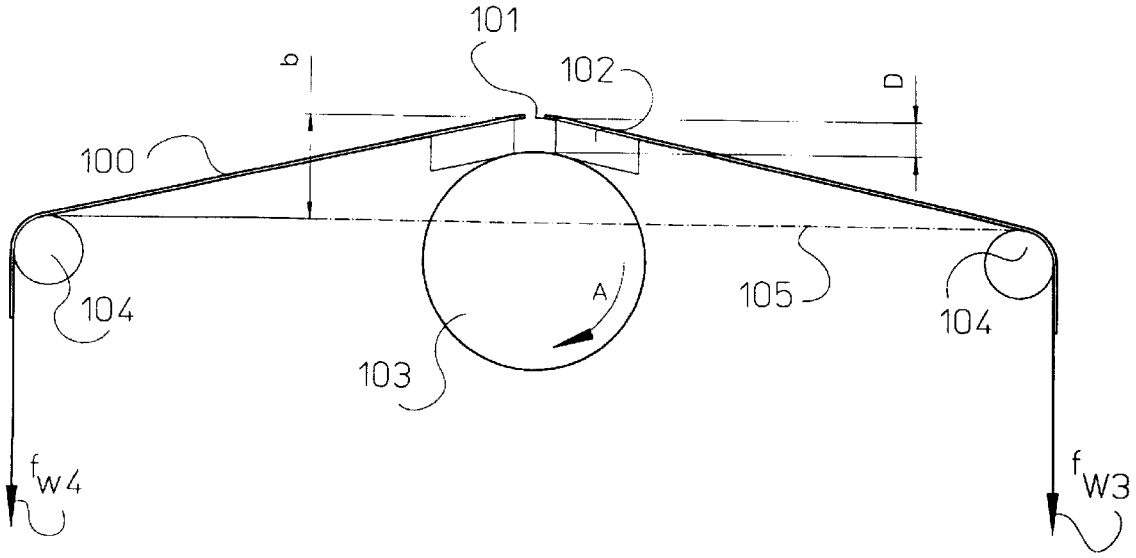
FIG. 2 shows a schematic sectional view of a printhead structure according to this invention, mounted in contact with a toner delivery means.

In a device according to this invention, the printhead structure is mounted in contact, via the spacer means, with the toner delivery means in such a way that the part of the printhead structure being in contact, via the spacer means, with the toner delivery means has a kind of a bulge extending between 0.2 and 20 mm above the line connecting the surface of supporting means for the printhead structure, that faces the printhead structure, preferably between 1 and 5 mm (both limits included). A schematic view of a printhead structure according to thus invention combined with a toner delivery means is given in FIG. 2. In this figure, the numerical 104 denotes means for supporting the printhead structure 100 and 103 denotes the toner delivery means, the driving means for said toner delivery means and the supporting means to support the toner delivery means in the DEP device are not shown. Arrows $f_{w3}$ and $f_{w4}$ denote forces exerted on the printhead structure in the length of this printhead structure and are thus part of $F_w$. The printhead structure 100 is pressed against the toner delivery means 103 by the forces $f_{w3}$ and $f_{w4}$ over spacing means 102. A portion of spacing means 102 shown by a dotted line, to show the printing apertures 101 in the printhead structure. The distance between the line 105 connecting the surfaces of the supporting means 104 and the printing apertures (b in FIG. 2) is the kind of bulge describe immediately above. The height of the bulge (b) is preferably such that $0.2 \leqq b \leqq 20$ mm, more preferably such that $1 \leqq b \leqq 5$ mm.

Figure 3:
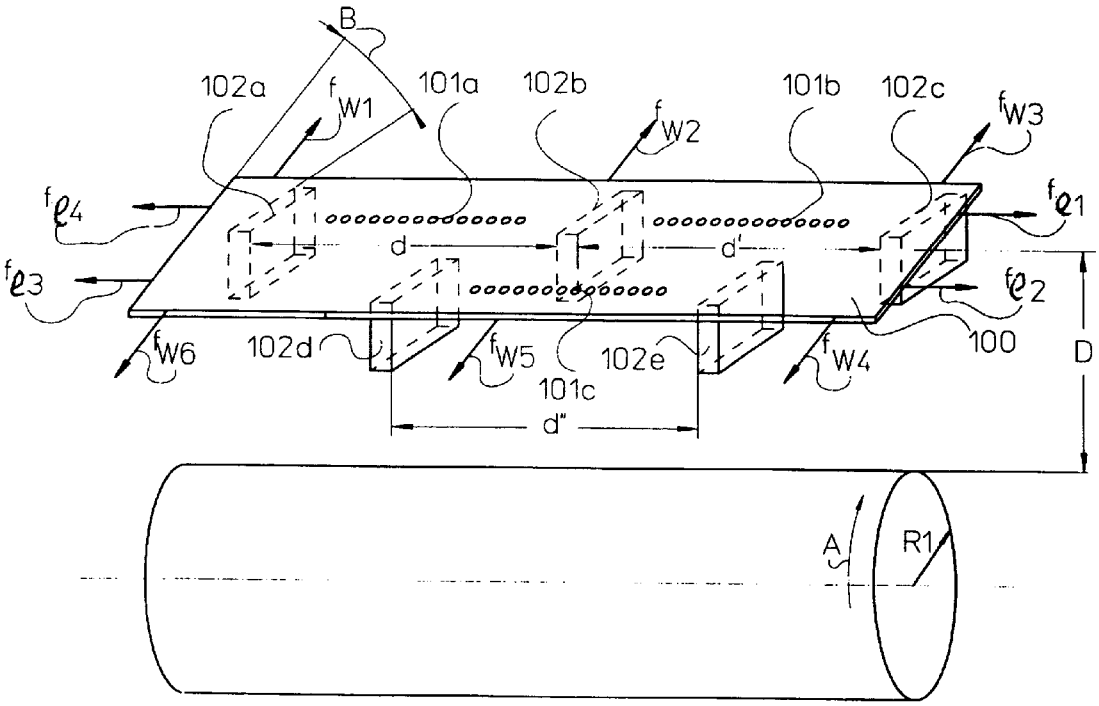
FIG. 3 shows a schematic view, viewed from the outer (external) surface of the toner delivery means, of a further embodiment of a printhead structure according to this invention.

A printhead structure according to this invention can be made in various forms: the printhead structure can carry one array of printing apertures (throughout this document, an "array of printing aperture" is used to indicate at least one row of printing apertures) between spacing means. It can carry a plurality of arrays of printing apertures, each of said arrays being located between two spacing means and the arrays being staggered. In FIG. 3 such a printhead structure is schematically shown: Two arrays of printing apertures (101*a*, 101*b*) are located adjacent to each other and each is located between two spacing means (102*a*, 102*b* and 102*c*) spacing means 102*b* being common to the two arrays of apertures. A third array of printing apertures (101*c*) between two spacing means (102*d* and 102*e*) is located in a staggered way with respect to the first two arrays of printing apertures. The spacing means are located at a given distance of each other (d, d' and d"). In FIG. 3, d, d' and d" are shown as being equal, but this is not necessarily so. Any printhead carrying a plurality of arrays of printing apertures, said arrays having equal or different numbers of printing apertures, each of said arrays being located between two spacing means and the arrays being staggered, is within the scope of the invention. E.g. a printhead structure with more than three arrays of printing apertures, that are equal or different in length, that comprise the same or a different number of rows of printing apertures and wherein the spacing means are equally or differently spaced is a printhead structure according to this invention.

A printhead structure useful in the present invention can also be a mesh shaped type of printhead structure as disclosed in e.g. U.S. Pat. No. 5,036,341. Preferably a printhead structure for use in a device according to this invention comprises a sheet of isolating material, preferably a polymeric material, wherein printing apertures are present. The toner flow form the toner delivery means to the receiving substrate in a DC-field between said toner delivery means and said substrate is controlled by control electrodes on the printhead structure. Various forms of control electrodes are possible, there can be a control electrode around every printing aperture, a single control electrode can control a row of printing apertures, as disclosed in e.g. U.S. Pat. No. 5,121,144, the control electrodes around each printing aperture can be segmented as disclosed in e.g. WO 94/26527. A printhead structure used in this invention can comprise a shield electrode on the face of the printhead structure opposite to the face carrying the control electrodes. Such a shield electrode can have various forms, it can be a continuous electrode, or it can have a form adapted to the printing apertures, as disclosed in EP-A 812 696.

The DC-field between the toner delivery means and the toner receiving substrate can be provided by applying a potential difference between said toner delivery means and a back electrode positioned behind said substrate, or it can be provided by applying a potential difference between said toner delivery means and said substrate itself as disclosed in EP-A 823 676.

The toner delivery means in a DEP device according to this invention, is a means comprising an endless outer (external) surface for carrying charged toner particles. It may be cylindrical or can have the form of an endless belt. The charged toner particles can originate from a magnetic mono-component developer. In that case it is beneficial that the toner delivery means comprise a magnetic field for attracting the charged toner particles to its surface. In other embodiment of this invention, the toner delivery means is an applicator using non-magnetic mono-component developer, i.e. the surface of the toner delivery means carries non-magnetic charged toner particles. In a further embodiment of the invention, the charged toner particles on the surface of the toner delivery means originate from a multi- (two-) component developer comprising magnetic carrier particles and non-magnetic charged toner particles, then the toner particles are deposited from a magnetic brush (wherein both carrier and charged toner particles are present) on the toner delivery means, whereon only charge toner particles are present. DEP devices using a magnetic brush carrying magnetic carrier particles and non-magnetic charged toner particles for bringing charged toner particles on to the toner delivery means, are described in e.g. EP-A 740 224.

In still an other embodiment of the invention the toner delivery means is a magnetic brush comprising magnetic carrier particles and non-magnetic toner particles and the toner particles are directly extracted from the "hairs" of the magnetic brush. In this embodiment the spacing means contact the sleeve of the magnetic brush and keep the distance between the magnetic brush and the printhead structure constant.

Whatever the way to bring toner particles (optionally in combination with carrier particles as "hairs" of a magnetic brush) to the surface of the toner delivery means it is preferred that the width of the toner layer (or of the layer of hairs of the magnetic brush) applied to the toner delivery means is smaller than or equal to the distance between the spacing means at the end of the array of printing apertures. By doing so, the spacing means do not squeeze toner particles between the surface of the toner delivery means and the surface of the spacing means contacting the toner delivery means, this means that no physical strain is imposed on the toner particles and that thus toner smearing, clogging of printing apertures by deformed (half molten) toner particles are largely prevented.

EXAMPLES

The Printhead Structure.

A printhead structure was made from a polyimide film of 50 μm thickness, double sided coated with a 5 μm thick copper film. On the back side of the printhead structure, facing the receiving substrate, a rectangular control electrode was arranged around each rectangular aperture. Each of said control electrodes was connected over 2 MΩ resistors to a HV 507 (trade name) high voltage switching IC, commercially available through Supertex, USA, that was powered from a high voltage power supply. On the front side of the printhead structure, facing the toner delivery means, a common shield electrode was present. The printhead structure had two rows of apertures. The apertures had an aperture size of 360 μm×120 μm. The size of the copper control electrodes was 520 μm×280 μm. The rows of apertures were staggered to obtain an overall resolution of 85 dpi. The printhead structure comprised a shield electrode, having a slit of 1.6 mm wide, the printing apertures being located in said slit. This is a shield electrode and a printhead structure according to the disclosures in EP-A 812 696. The printhead structure comprised two strips of polyurethane as spacing means. The spacing means were 300 μm thick and 10 mm wide and were placed at a distance (d) of 0.165 m.

The Toner Delivery Means

The toner delivery means was a commercially available toner cartridge comprising non magnetic mono component developer, the COLOR LASER TONER CARTRIDGE MAGENTA (M3760GIA), for the COLOR LASER WRITER (Tradenames of Apple Computer, USA).

The Printing Engine

The printhead structure and the charged toner conveyer were mounted in a frame and the printhead structure was stretched in said frame by spring coils and pressed against said charged toner conveyer, via the spacing means. The distance between the charged toner conveyer and the printhead structure was 300 μm, i.e. the thickness of the spacing means. The printhead structure was mounted in contact, via the spacer means, with the toner delivery means in such a way that the part of the printhead structure being in contact with the toner delivery means has a kind of a bulge extending 1 mm above the line connecting the surface of supporting means for the printhead structure.

A back electrode was present behind the paper whereon the printing proceeded, the distance between the back electrode and the back side of the printhead structure (i.e. control electrodes) was set to 750 μm and the paper travelled at 2 cm/sec. The shield electrode was grounded: V2=0 V. To the individual control electrodes an (imagewise) voltage V3 between 0 V and −280 V was applied. The back electrode was connected to a high voltage power supply of +1000 V. To the sleeve of the toner delivery means an AC voltage of 250 V($V^{rms}$, root means square voltage) at 3.0 kHz was applied, with −100 V DC offset. Thus |AC/DC|=2.5.

PRINTING EXAMPLES

The printing quality of the printing examples below was visually judged on two criteria and given a quality figure from 5, very good to 1, bad. The two criteria were evenness of density in the printing direction (EPD) and evenness of density in a direction perpendicular to the printing direction (EPPD). A total printing quality (TQ) was given as (EPD+EPPD)/2.

Also the density that was obtained was judged on a relative scale ($D_{max}$).

For all examples and for the comparative example, the results are tabulated in table 1.

Example 1 (E1)

A printhead structure as described above was used, with $F_l$=2220 N/m, acting over four application points being 50 mm apart and $F_w$=1500 N/m, $F_{wb}$=500 N/m, $F_{wo}$=1000 N/m, acting over six application points being 200 mm apart. |AC/DC|=2.5. The distance, d, between the spacing means was 0.165 m.

Example 2 (E2)

A printhead structure as described above was used, with $F_l$=2220 N/m, acting over four application points being 50 mm apart and $F_w$=1000 N/m, $F_{wb}$=500 N/m, $F_{wo}$=500 N/m, acting over eight application points being 200 mm apart. |AC/DC|=2.5. The distance, d, between the spacing means was 0.165 m.

Example 3 (E3)

A printhead structure as described above was used, with $F_l$=2220 N/m, acting over four application points being 50 mm apart and $F_w$=90 N/m, $F_{wb}$=0 N/m, $F_{wo}$=90 N/m, acting over four application points being 200 mm apart. |AC/DC|=2.5. The distance, d, between the spacing means was 0.165 m.

Example 4 (E4)

Example 3 was repeated, except for the DC and AC-field. A DC-field of −30 V was applied to the sleeve of the toner delivery means and an AC voltage of 1000 V ($V^{rms}$). |AC/DC|=30.3.

Comparative Example (CE)

A printhead structure, as described above, was mounted on a four frame bar, as described in EP-A 712 056, with four points of application for $F_l$, acting over 50 mm and giving a force per linear m of 2000 N/m and with six points of application for $F_w$, acting over 200 mm, and giving a force per linear m of 750 N/m. On the outer (external) surface of the toner delivery means a DC-field of −100 V was applied and an AC-field of 300 $V^{rms}$ superimposed to said DC-field. |AC/DC|=3.0.

The toner delivery means was arranged at 300 μm of the printhead structure and NO spacing means were present. I.e. the printhead structure and the toner delivery means made NO contact at all.

TABLE 1

| Nr | $F_w/F_l$ | $F_w/d$ | \|AC/DC\| | EPD | EPPD | TQ | $D_{max}$ |
|---|---|---|---|---|---|---|---|
| E1 | 0.676 | 9090 | 2.5 | 5 | 2.5 | 3.75 | 1 |
| E2 | 0.450 | 6060 | 2.5 | 5 | 4 | 4.5 | 1 |
| E3 | 0.041 | 550 | 2.5 | 5 | 5 | 5 | 1 |
| E4 | 0.041 | 550 | 30.3 | 5 | 5 | 5 | 2 |
| CE | 0.375 | n.a. | 3.0 | 1 | 5 | 3 | 1 |

The headings of the table have the meaning as explained in the text, n.a. means not applicable.

It is clear that by using a printhead structure according to this invention a higher printing quality can be achieved than with a DEP device wherein no spacing means are present.

What is claimed is:

1. A device for direct electrostatic printing comprising:

means with an external surface carrying charged toner particles for creating a flow of toner particles, means for moving said external surface in a direction A, a printhead structure, having a first and a second major face, with printing apertures and control electrodes, placed in said flow of toner particles for image-wise controlling said flow, said first major face of said printhead structure facing said external surface and at least two spacing means placed between said first major surface and said external surface under an angle between 45° and 0° with respect to said direction A and at a distance, d, from each other so that 1 cm≦d≦50 cm for keeping said first major face and said external surface at a constant distance, D, from each other.

2. A device according to claim 1, wherein said spacing means are placed at a distance d from each other such that 5 cm≦d≦35 cm.

3. A device according to claim 2, wherein said constant distance D is such that 25 μm≦D≦500 μm.

4. A device according to claim 2, wherein said constant distance D is such that 50 μm≦D≦300 μm.

5. A device according to claim 1, wherein said constant distance D is such that 25 μm≦D≦500 μm.

6. A device according to claim 1, wherein said constant distance D is such that 50 μm≦D≦300 μm.

7. A device according to claim 1, wherein said printhead structure comprises a polymeric substrate wherein printing apertures are present.

8. A device according to claim 7, wherein said printhead structure has a plurality of arrays of printing apertures, each of said arrays is located between two spacing means and said arrays are staggered.

9. A device according to claim 1, further comprising resilient means for keeping said first major face of said printhead structure in place with respect to said spacing means and said external surface.

10. A device according to claim 9, wherein said resilient means exert a force on said printhead structure in a direction parallel to said printing apertures, $F_l$, and a force in a direction perpendicular to said printing apertures, $F_w$, and wherein $F_w/F_l \leqq 0.5$.

11. A device according to claim 10, wherein said force $F_w$ and said distance d are such that $F_w/d<5000$.

12. A device according to claim 1, further comprising means for applying a DC-voltage to said external surface and means for superimposing an AC-voltage on said DC-voltage so that $10 \leqq |AC/DC| \leqq \infty$.

* * * * *